United States Patent [19]

Hodge

[11] 4,146,171

[45] Mar. 27, 1979

[54] NEWSPAPER DELIVERY BOX

[76] Inventor: Joel W. Hodge, 208 Riverview Ct., Elizabethton, Tenn. 37643

[21] Appl. No.: 798,152

[22] Filed: May 18, 1977

[51] Int. Cl.[2] ..... A47G 29/12

[52] U.S. Cl. ..... 232/1 C; 232/17; 232/39

[58] Field of Search ..... 232/1 C, 17, 24, 38, 232/39

[56] References Cited

U.S. PATENT DOCUMENTS

| | | | |
|---|---|---|---|
| 1,052,981 | 2/1913 | Strobel | 232/24 |
| 1,137,740 | 5/1915 | Challeen | 232/24 |
| 1,564,073 | 12/1925 | Johnson | 232/17 |
| 2,709,038 | 5/1955 | Marcus et al. | 232/17 |
| 3,081,023 | 3/1963 | Taylor | 232/39 X |
| 3,243,104 | 3/1966 | Fillion | 232/39 X |
| 3,515,337 | 6/1970 | Bornus | 232/33 |
| 3,942,715 | 3/1976 | Anderson | 232/17 |
| 4,026,461 | 5/1977 | Hodge | 232/1 C |

*Primary Examiner*—James T. McCall
*Assistant Examiner*—Peter A. Aschenbrenner
*Attorney, Agent, or Firm*—R. Laddie Taylor

[57] ABSTRACT

A newspaper delivery box adapted to support and attach a mailbox thereto has a support insert provided therein to lift a newspaper contained in the box away from the bottom of the box to thereby protect the newspaper from water contained thereon. Optionally, at least one divider is provided in the box to retain a plurality of newspapers within the box.

8 Claims, 11 Drawing Figures

NEWSPAPER DELIVERY BOX

BACKGROUND OF THE INVENTION

1. Field of the Invention

Newspaper delivery in rural areas traditionally requires the placement of a delivery box beside a street or road, the box being located such that a newpaper may be deposited therein from a vehicle such as an automobile or bicycle. This delivery box is conventionally attached to the side of a mailbox or is supported by a separate post, usually located near the mailbox.

While this arrangement is adequate under some circumstances, it would be advantageous to have the newspaper delivery box and mailbox "stacked" to provide the required firm, substantial support of the mailbox and delivery box utilizing one support post. There is a need for this type of unit especially in the case where a large number of mailboxes are positioned in side-by-side relationship to serve, for example, a large rural appartment complex.

Additionally, a newspaper delivery box often becomes wet on the inside, and especially on the bottom, during a rain shower or the like, resulting in a newspaper becoming wet and unreadable when deposited in the box such that it lies directly on the bottom thereof. It would be desirable to provide a means to prevent the newspaper from becoming wet by avoiding any direct contact of the newspaper with the bottom of the box.

Due to the growing demand by the public for information and news, both local and international, it has become a custom for individuals to subscribe to more than one newspaper. The positioning of more than one newspaper box upon or near a rural mailbox is inconvenient as well as unsightly. In the case where one large delivery box may be utilized for more than one newspaper, the plurality of newspaper are apt to become disarrayed and rumpled within the box, especially if the newspapers are not esentially the same size and are not supported in a formed fashion by some means, such as in rolled form supported by a rubber band.

2. Description of the Prior Art

U.S. Pat. No. 3,243,104 — Fillion discloses a newspaper receiver combined with a mailbox and supporting post. While this reference generally provides a stacked newspaper box-mailbox combination, several inadequacies remain. The reference requires that the mailbox be attached thereto at all times to provide a top for the newspaper receiver. In the instant invention, it is not essential that a mailbox be positioned on the newspaper delivery box in order that the box is in condition to receive newspapers. The mailbox may be removed from the newspaper delivery box of the invention for any period of time, in the case of damage to the mailbox or malfunction of the front closure thereof, for example, without hindering the function of the delivery box. Additionally, a special support post is required as part of the reference structure, whereas the newspaper delivery box of the instant invention is provided with a universal mounting means generally adapted to be supported by an existing mailbox support means. Further, absolutely no means are provided within the reference structure to prevent the structure from retaining water on the bottom thereof as a result of rain or the like, which would cause a newspaper deposited therein to become moisture-laden and unreadable.

Applicant's U.S. patent application Ser. No. 700,918, filed June 29, 1976, now U.S. Pat. No. 4,026,461, the teachings of which are herein incorporated as reference under the authority of Section 608.01(p) of the *Manual of Patent Examining Procedure,* discloses a newspaper support insert for use in a newspaper delivery tube comprising a horizontally corrugated wedge of about one-half the length of the delivery tube, the support possessing a reversely turned forward clamp to engage the lower front edge of the open end of the tube and at least one drainage hole in each trough of the corrugated surface. The purpose of this insert is to support a newspaper above the bottom of the delivery tube to prevent the newspaper from becoming wet from water which has been retained in the bottom thereof. While this insert generally provides a means to prevent the newspaper from lying on the bottom of the delivery tube, it has been found that on occasion, especially in the case of small local newspapers, the newspaper becomes positioned on the support such that the portion of the newspaper nearest the back of the tube, due to a tipping action caused by the corrugations of the insert coupled with the comparatively light weight of the relatively small newspaper, becomes damp or wet from small amounts of water located in the rear portion of the delivery tube.

BRIEF DESCRIPTION OF THE DRAWINGS

The invention will become more apparent when described in conjunction with the drawings, in which like reference numerals designate like parts in the several views, and wherein.

DESCRIPTION OF THE PREFERRED EMBODIMENTS

Figure 2:
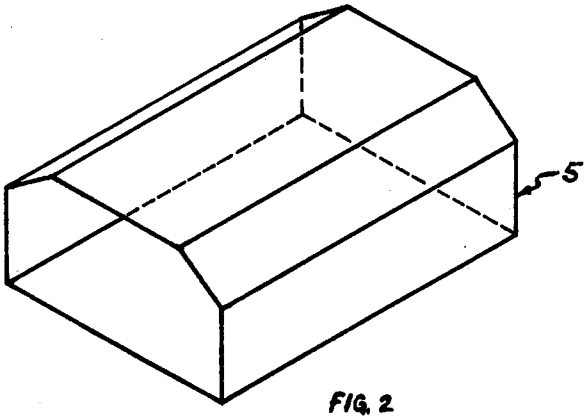
FIG. 2 is a perspective view of the truncated octagonal parallelopiped of the invention.
Figure 1:
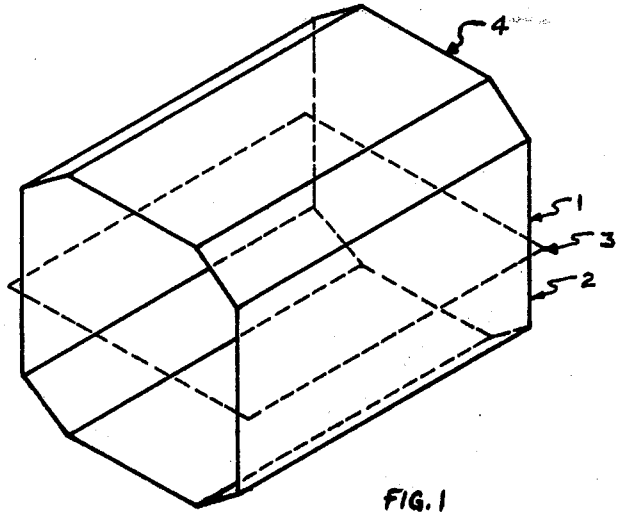
FIG. 1 is a dimensional view of an elongated octagonal parallelopiped divided in half by a truncating plane parallel to one elongated side thereof, illustrating the configuration of the newspaper box of the invention.

Referring now to FIG. 1, an elongated octagonal parallelopiped is divided into upper and lower equal parts 1 and 2 respectively by truncating the octagonal parallelopiped with a plane 3, illustrated in the figure using broken lines, the plane being parallel to one elongated side 4 of the parallelopiped, side 4 being illustrated as the top side of the parallelopiped in this figure, thus providing section 5 of FIG. 2 which is the configuration of the newspaper delivery box of the invention. This parallelopiped, by definition, is not a regular polyhedron and the sides thereof, other than the respective parallel sides, are therefore not required to have equal dimensions.

Figure 3:
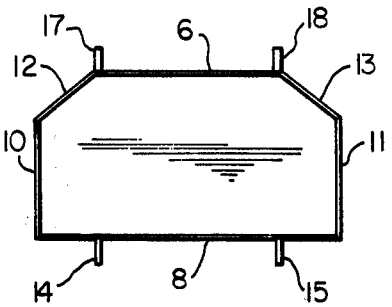
FIG. 3 is a front view of the truncated octagonal parallelpiped of FIG. 2 having additional features to provide the newspaper delivery box of the invention.
Figure 4:
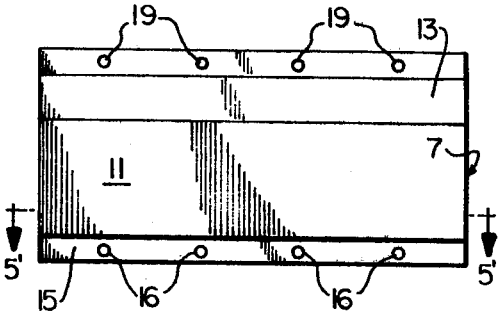
FIG. 4 is a side view looking toward the right of the truncated octagonal parallelopiped of FIG. 3 showing additional features of the newspaper delivery box of the invention.
Figure 5:
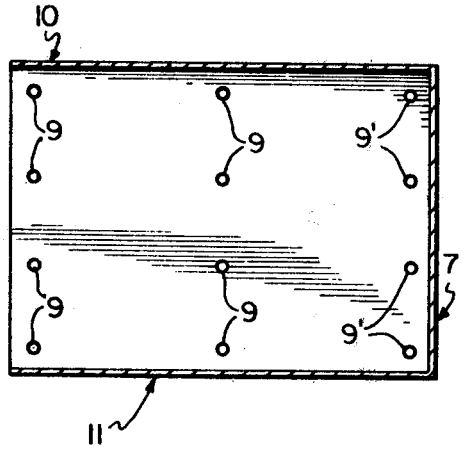
FIG. 5 is a sectional top view along lines 5'—5' of FIG. 4 of the truncated octagonal parallelopiped of FIG. 2 showing additional features of the newspaper delivery box of the invention.

FIG. 3, FIG. 4 and FIG. 5 comprise a front view, side view of FIG. 3 looking toward the right, and sectional top view taken along lines 5'—5' of FIG. 4 respectively of the newspaper delivery box having substantially the configuration of one half of an elongated octagonal parallelopiped produced by dividing an elongated octagonal parallelopiped by truncating with a plane parallel to one elongated side thereof, the delivery box comprising a top 6, a back end 7, a bottom 8 having a width substantially wider than the top 6 and containing a plurality of drainage holes 9, including at least one drainage hole 9' located adjacent the back end 7 of the box, two parallel sides 10 and 11 which join with and are perpendicular to the bottom 8 of the box, and two additional sides 12 and 13 joining the parallel sides 10 and 11 respectively to the top 6, the delivery box being adapted to be attached to a support means through the use of two vertical flanges 14 and 15 which extend downwardly and lie perpendicular to the bottom 8 of the box and which extend substantially the length of the delivery box and contain a plurality of holes 16 to receive screws or the like to provide means for securely attaching the box to the support structure, and being further adapted to support and attach a conventional rural mailbox thereupon through the use of two vertical flanges 17 and 18 which extend upwardly and lie perpendicular to the top 6 and extend substantially the length of the box and contain a plurality of holes 19 provided to receive screws or the like to provide means for securely attaching a mailbox thereto. The location of the flanges are more fully illustrated in FIG. 6, which is a perspective view of the newspaper delivery box of the invention illustrating the configuration thereof and more clearly showing the various parts discussed above.

Figure 6:
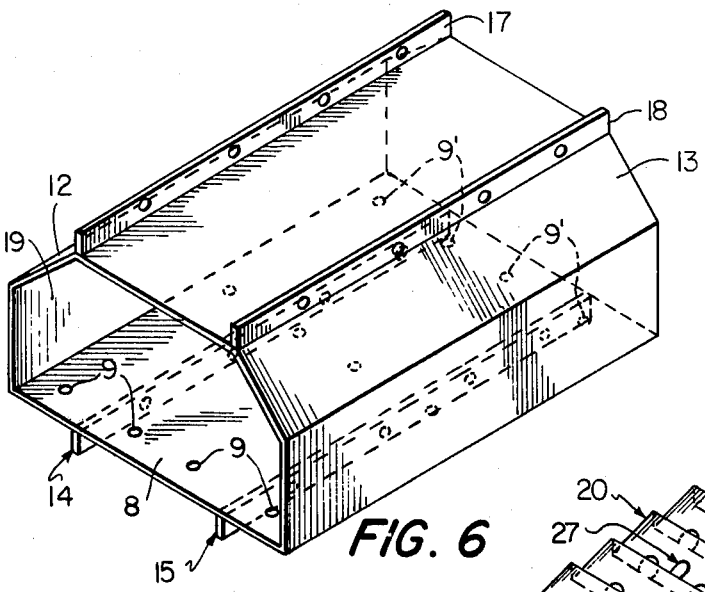
FIG. 6 is a perspective view comprising a newspaper delivery box having the shape of a truncated octagonal parallelopiped designed such that a mailbox can be mounted directed thereon.
Figure 7:
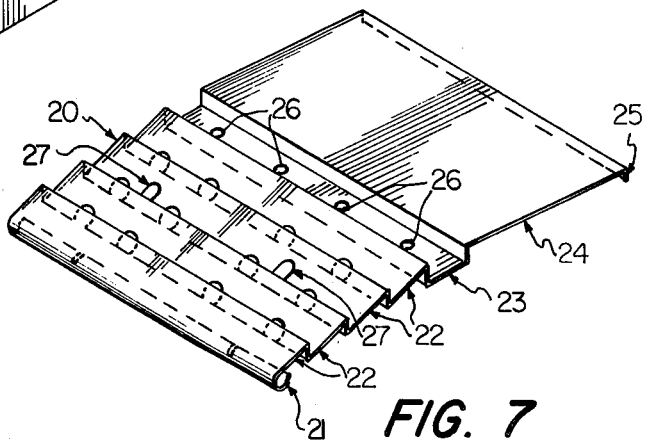
FIG. 7 is a perspective view of a support insert for the newspaper delivery box of FIG. 6.

FIG. 7 comprises a false bottom 20 for the delivery box of FIG. 6 consisting of, from front to back, a reversely curved clamp means 21 to engage the front edge of the bottom 8 of the box of FIG. 6, a corrugated surface 22 provided to extend about half the length of the false bottom 20, a first support section 23 to raise the false bottom 20 from the bottom 8 of the box, a smooth surface 24 which will lie in spaced relation above the bottom 8 of the box, and a second support section 25 of less height than the first support section 23 which will extend to the bottom 8 of the box. One or more drainage holes 26 are preferably provided in the bottom of each trough of the corrugated surface 22 of the false bottom 20. Additionally, at least one portion of the corrugated surface 22 of the false bottom 20 may be formed into one or more tabs 27 curved into a spaced relationship above the corrugated surface 22 to act as a clip holder for small flat objects, such as payment envelopes placed between the tab and the corrugated surface.

Figure 8:
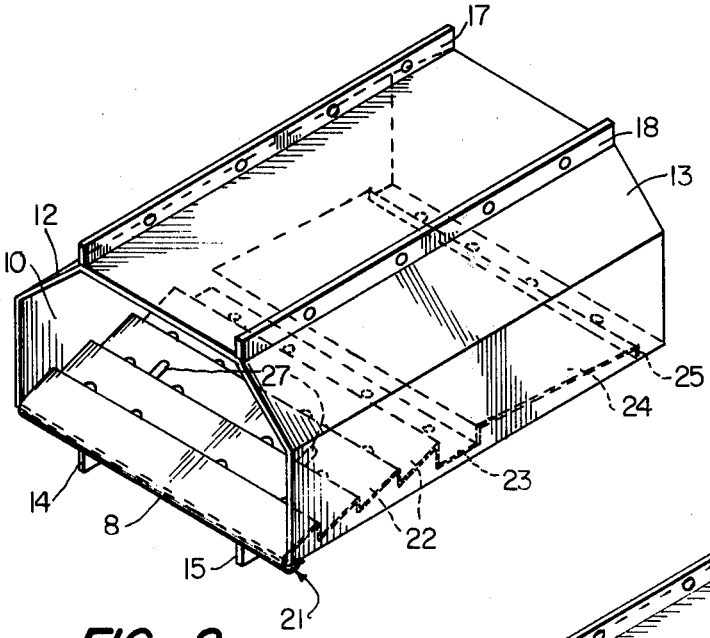
FIG. 8 is a perspective view of the newspaper delivery box of FIG. 6 with the insert of FIG. 7 positioned on the bottom thereof.

FIG. 8 illustrates the newspaper delivery box of FIG. 6 containing the false bottom 20 of FIG. 7, comprising an open-front newspaper delivery box having substantially the configuration of one half of an elongated octagonal parallelopiped produced by dividing an elongated octagonal parallelopiped by truncating with a plane parallel to one elongated side thereof, the delivery box comprising a top, a back end, a bottom having a width substantially wider than the top and containing a plurality of drainage holes including at least one drainage hole located adjacent the back of the box, two parallel sides which join and lie perpendicular to the bottom of the box, two additional sides joining the parallel sides to the top, and a false bottom, the delivery box being adapted to be attached to a support means through the use of two vertical flanges which extend downwardly and lie perpendicular to the bottom of the box and extend substantially the length of the box, the box further being adapted to support and attach a conventional rural mailbox thereupon through the use of two vertical flanges which extend upwardly and lie perpendicular to the top of the box and extend substantially the length of the box, wherein the false bottom consists of, from front to back of the box, a reversely curved clamp means to engage the front edge of the bottom of the box, a corrugated surface extending about one half the length of the box, a first support section to raise the false bottom from the bottom of the box, a smooth surface in spaced relation above the bottom of the box and a second support section of less height from the bottom of the box than said first support section, the false bottom extending substantially the length of the box while allowing at least one drainage hole located adjacent the back end of the box to remain exposed.

Preferably, at least one portion of the corrugated surface of the false bottom is formed into one or more tabs curved into a spaced relationship above the corrugated surface to act as a clip holder for small flat objects, such as payment envelopes, placed between the tab and the corrugated surface.

Figure 9:
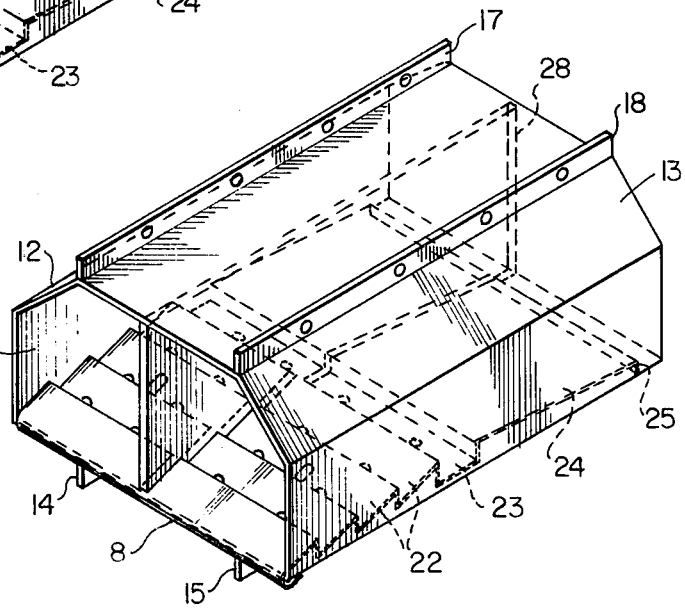
FIG. 9 is a perspective view of an alternate embodiment of the invention comprising the newspaper delivery box of FIG. 8 with the modification that a divider or partition is provided which divides the newspaper delivery box into two sections.

FIG. 9 illustrates the newspaper delivery box of FIG. 8 wherein the box is divided into two component sections by vertical partition 28 extending substantially from the open front of the box to the back end. It is apparent that a plurality of component sections may be provided in the newspaper delivery box using vertical partitions according to the requirements of the consumer.

Figure 10:
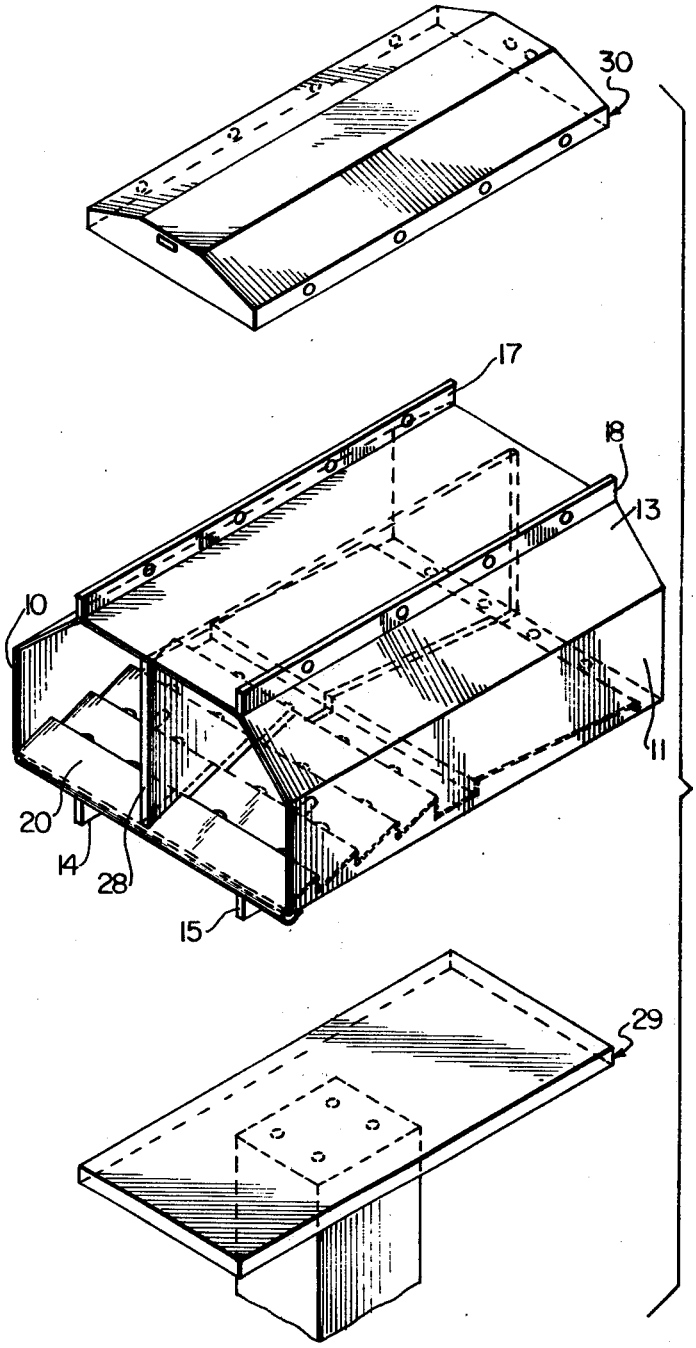
FIG. 10 is a perspective view of the newspaper delivery box of FIG. 9 illustrating how a top section or cap may be positioned and mounted thereon, and further illustrating how the box may be mounted to a conventional support means.

FIG. 10 illustrates how the newspaper delivery box of FIG. 9 may be mounted to a conventional mailbox support means 29. A top section 30 may be mounted on the delivery box if desired in the case where the box is utilized without a mailbox.

Figure 11:
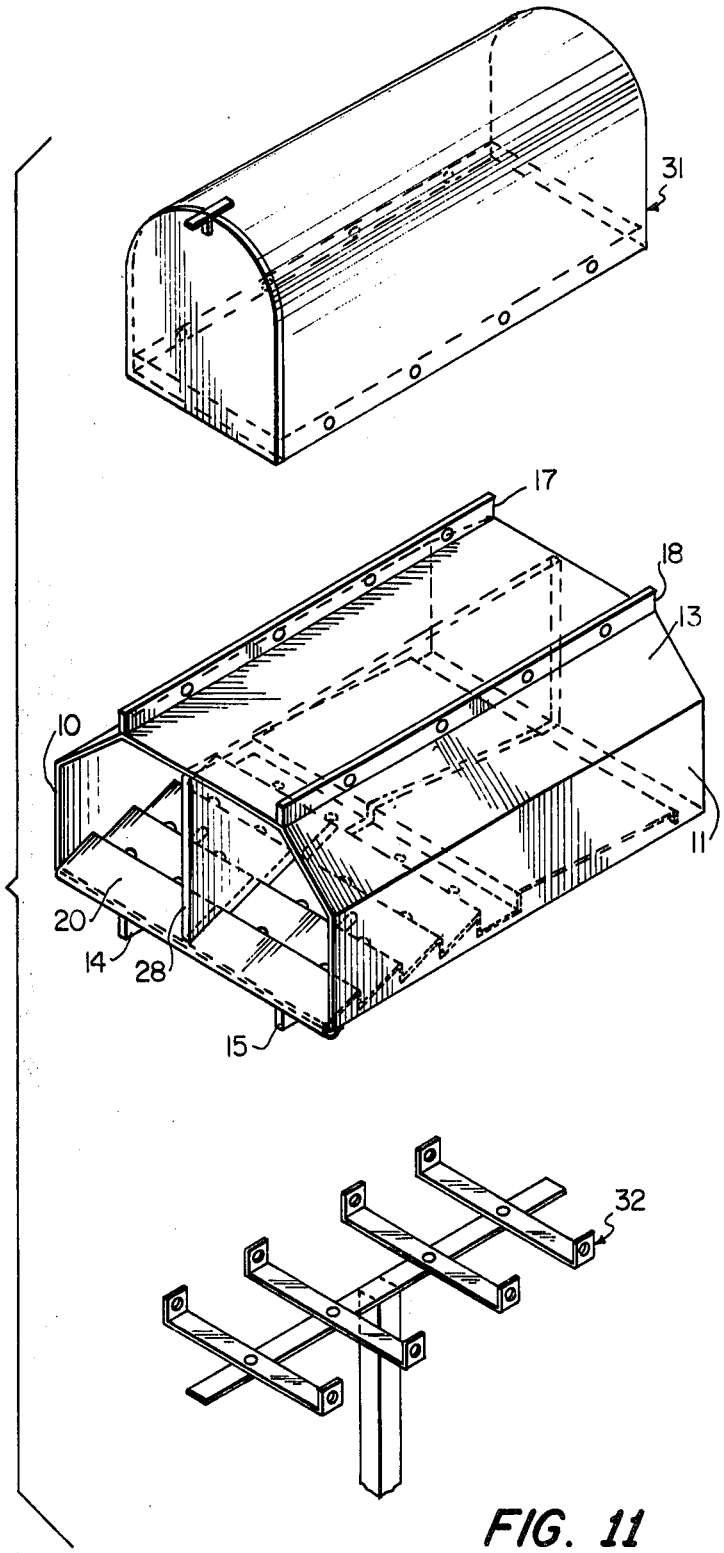
FIG. 11 is a perspective view of the newspaper delivery box of FIG. 9 illustrating how a mailbox may be positioned and mounted thereon, and further illustrating how the box may be mounted to an alternate support means.

FIG. 11 illustrates how a conventional rural mailbox 31 may be positioned and mounted on the newspaper delivery box of FIG. 9 and further illustrates how the delivery box may be mounted on alternate support means 32.

The newspaper delivery box herein disclosed may be fabricated by methods well known in the art, such as by forming separate parts from sheet metal or the like and assembling according to the invention or by stamping or molding from desired materials.

While the invention has been described in detail with reference to the drawings and specific embodiments thereof, it will be apparent to one skilled in the art that various changes and modifications can be made therein without departing from the scope and spirit thereof, and, therefore, the invention is not intended to be limited except as indicated in the appended claims.

I claim:

1. An open-front newspaper delivery box having substantially the configuration of one half of an elongated octagonal parallelopiped produced by dividing an elongated octagonal parallelopiped by truncating with a plane parallel to one elongated side thereof, said delivery box comprising a top, a back end, a bottom having a width substantially wider than said top and containing a plurality of drainage holes including at least one drainage hole located adjacent said back end of the box, two parallel sides which join with and lie perpendicular to said bottom, two additional sides joining said parallel sides to said top, and a false bottom extending substantially the length of the box while allowing at least one drainage hole located adjacent the back end of the box to remain exposed, said delivery box adapted to be attached to a support structure and to support and attach a conventional rural mailbox thereon; wherein the false bottom consists of a surface having wedge shaped corrugations formed therein extending about one-half the length of the box, a first support means formed in said surface at about the midpoint thereof, said surface terminating in a second support means formed therein of less height than said first support means, and having a reversely curved forward clamp means formed therein to engage the lower surface of the front edge of the bottom of the box.

2. The newspaper delivery box of claim 1 wherein there is at least one drainage hole in the bottom of each trough of the corrugated surface of the false bottom.

3. The newspaper delivery box of claim 1 wherein the box is divided into a plurality of component sections by vertical partitions extending substantially from the open front of the box to the back end.

4. The newspaper delivery box of claim 2 wherein the box is divided into a plurality of component sections by vertical partitions extending substantially from the open front of the box to the back end.

5. The newspaper delivery box of claim 1 wherein at least one portion of the corrugated surface of the false bottom is formed into a tab curved into a spaced relationship above the corrugated surface to act as a clip holder for small flat objects placed between the tab and the corrugated surface.

6. The newspaper delivery box of claim 2 wherein at least one portion of the corrugated surface of the false bottom is formed into a tab curved into a spaced relationship above the corrugated surface to act as a clip holder for small flat objects placed between the tab and the corrugated surface.

7. The newspaper delivery box of claim 3 wherein at least one portion of the corrugated surface of the false bottom is formed into a tab curved into a spaced relationship above the corrugated surface to act as a clip holder for small flat objects placed between the tab and the corrugated surface.

8. A false bottom for a newspaper delivery box extending substantially the length of the box and consisting of a surface having wedge shaped corrugations formed therein extending about one-half the length of the box, a first support means formed in said surface at about the midpoint thereof, said surface terminating in a second support means formed therein of less height than said first support means, and having a reversely curved forward clamp means formed therein to engage the lower surface of the front edge of the bottom of the box.

* * * * *